US011519047B2

(12) United States Patent
Holzweissig et al.

(10) Patent No.: US 11,519,047 B2
(45) Date of Patent: Dec. 6, 2022

(54) MOTOR VEHICLE COMPONENT AND A METHOD OF MANUFACTURING THEREOF

(71) Applicant: Benteler Automobiltechnik GmbH, Paderborn (DE)

(72) Inventors: Martin Holzweissig, Paderborn (DE); Georg Frost, Steinheim (DE); Ruediger Erhardt, Paderborn (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 887 days.

(21) Appl. No.: 15/592,545

(22) Filed: May 11, 2017

(65) Prior Publication Data

US 2017/0327917 A1 Nov. 16, 2017

(30) Foreign Application Priority Data

May 12, 2016 (DE) ..... 10 2016 108 836.6

(51) Int. Cl.
*C21D 9/00* (2006.01)
*C21D 1/06* (2006.01)
(Continued)

(52) U.S. Cl.
CPC ..... *C21D 9/0068* (2013.01); *C21D 1/06* (2013.01); *C21D 8/005* (2013.01); *C22C 38/002* (2013.01);
(Continued)

(58) Field of Classification Search
CPC ..... C21D 9/00; C21D 9/0068; C21D 1/06; C21D 8/005; C21D 2211/002;
(Continued)

(56) References Cited

U.S. PATENT DOCUMENTS 5,122,336 A * 6/1992 Roux ..... C22C 38/44 148/335
2007/0107819 A1 5/2007 Gehringhoff et al.
(Continued)

FOREIGN PATENT DOCUMENTS

DE 102005054847 B3 10/2007
DE 102010003997 A1 7/2011
(Continued)

OTHER PUBLICATIONS

Vander Voort et al. "Understanding and Measuring Decarburization" Advanced Materials & Processes Feb. 2015 (Year: 2015).*
(Continued)

*Primary Examiner* — Alexandra M Moore
(74) *Attorney, Agent, or Firm* — Hauptman Ham, LLP

(57) ABSTRACT

A motor vehicle component and a method of manufacturing thereof is disclosed having at least regionally high-strength and at the same time ductile properties, including providing a sheet metal blank composed of a hardenable steel alloy with at least 0.25% carbon fraction, at least partially heating the sheet metal blank to above austenitizing temperature, in less than 20 seconds, hot-forming and press-hardening the sheet metal blank, in the process, setting a tensile strength Rm of greater than 1800 MPa and an elongation at break A20 of greater than 6%.

18 Claims, 3 Drawing Sheets

(51) Int. Cl.

| | |
|---|---|
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/34*** | (2006.01) |

(52) U.S. Cl.
CPC ..... *C22C 38/02* (2013.01); *C22C 38/04* (2013.01); *C22C 38/06* (2013.01); *C22C 38/34* (2013.01); *C21D 2211/002* (2013.01); *C21D 2211/008* (2013.01)

(58) Field of Classification Search
CPC . C21D 2211/008; C22C 38/002; C22C 38/02; C22C 38/04; C22C 38/06; C22C 38/34
See application file for complete search history.

(56) References Cited

U.S. PATENT DOCUMENTS

| | | | | |
|---|---|---|---|---|
| 2011/0182765 | A1 | 7/2011 | Giefers et al. | |
| 2012/0090741 | A1 | 4/2012 | Pellmann et al. | |
| 2012/0091758 | A1 | 4/2012 | Zimmermann et al. | |
| 2013/0160906 | A1 | 6/2013 | Bake et al. | |
| 2014/0000765 | A1 | 1/2014 | Nozaki et al. | |
| 2016/0067763 | A1 | 3/2016 | Graff et al. | |
| 2016/0186280 | A1 | 6/2016 | Breidenbach et al. | |
| 2016/0215360 | A1* | 7/2016 | Koyer ..... | C25D 3/22 |

FOREIGN PATENT DOCUMENTS

| | | | | |
|---|---|---|---|---|
| DE | 102011057007 | A1 | 6/2013 | |
| DE | 102013108265 | A1 | 2/2015 | |
| DE | 102014112755 | A1 | 3/2016 | |
| EP | 1961832 | A1 | 8/2008 | |
| EP | 2441850 | A1 | 4/2012 | |
| EP | 2848715 | A1 * | 3/2015 | ..... C22C 38/06 |
| WO | 2012146384 | A1 | 11/2012 | |

OTHER PUBLICATIONS

Espacenet Machine Translation of EP 2 848 715 (Year: 2020).*
Chinese Office Action for Application No. 201710175978.5 dated May 4, 2018; 20pp.
Opposition of German Application No. 10 2016 108 836 84 dated Feb. 22, 2019; 34pp.
"Influence of Short Austenitization Treatments on the Mechanical Properties of Low Alloy Boron Steel", Excerpt from "Hot Sheet Metal Forming of High-Performance Steel CHS2", pp. 481-488, 5th International Conference, 2015 Toronto, Canada; 9pp.
"Evolution of Microstructure and Properties of Steel 22MnB5 due to Short Austenitization with Subsequent Quenching", Excerpt from "steel research int. 87 (2016) No. 12", pp. 1733-1741, Published online: May 4, 2016; 9pp.
"Setting Mechanical Properties of High Strength Steels for Rapid Hot Forming Processes", Materials 2016, 9, 229 doi:10.3390/ma9040229, Published: Mar. 25, 2016; 19pp.
"Iron materials—steel and cast iron", H. Berns, W.Theisen, DOI 10.1007/978-3-540-79957-3, 2008 Springer-Verlag Berlin Heidelberg, pp. 386-387; 39pp.
"Characterization of the Bendability of Press-Hardened 22Mn85 Steel", steel research int. 85 (2014) No. 5, S. 824-835, Published online: Jan. 14, 2014; 12pp.
Wikipedia article "Form hardening", retrieved on Feb. 19, 2019; 5pp.
Datasheet 22MnB5 from Salzgitter Flachstahl, Jan. 2014; 3pp.
Datasheet 37MnB5 from Salzgitter Flachstahl, Dec. 2015; 4pp.
Office Action for Chinese Application No. 201710175978.5 dated Jul. 31, 2019; 7pp.

* cited by examiner

MOTOR VEHICLE COMPONENT AND A METHOD OF MANUFACTURING THEREOF

CROSS REFERENCE TO RELATED APPLICATIONS

The present application claims priority to German Application Number 10 2016 108 836.6 filed May 12, 2016, the disclosure of which is hereby incorporated by reference herein in its entirety.

BACKGROUND OF THE INVENTION

1. Field of the Invention

The present invention relates to a motor vehicle component and a method manufacturing the same and, more specifically, to a motor vehicle component made from a hardenable steel alloy having a carbon fraction.

2. Description of the Related Art

Manufacturing motor vehicle components formed from sheet metal components is known from the prior art. The blanks made of a steel alloy or light-metal alloy are provided and are subjected to technical forming in such a way as to obtain a three-dimensionally shaped motor vehicle components. A motor vehicle component of this kind is used, for example, as a structural component in a self-supporting vehicle body. It may also be attached by screwing in the form of a cross-member, door impact beam, crash box, or the like.

Additionally, the manufacturing process may involve hot-forming and press-hardening technology. A blank made of a hardenable steel alloy is heated at least regionally to above austenitizing temperature. The blank is then formed in this hot state with the hot forming allowing for high degrees of freedom and flexibility in shaping the blank.

The formed motor vehicle component is subsequently subjected to rapid cooling in such a way that the material microstructure is hardened and hence high-strength or even ultra high-strength properties are set. One of the disadvantages of such a process is that a material having a set hardness is at the same time also brittle. An occasional requirement here is for the component to have ductile properties so as not to break or tear off in the event of, for example, a motor vehicle crash.

During the process, possible tensile strengths which are achieved with the hot-forming and press hardening are 1000 to 1650 MPa.

SUMMARY OF THE INVENTION

It is therefore an object of the present invention to provide a motor vehicle component having a relatively high hardness as well as ductile material properties.

A method for producing a motor vehicle component having at least regionally high-strength and at the same time ductile properties is distinguished accordingly by the following steps:

- providing a sheet metal blank composed of a hardenable steel alloy with at least 0.25% carbon fraction,
- at least partially heating the sheet metal blank to above austenitizing temperature, in less than 20 s,
- hot-forming and press-hardening the sheet metal blank,

- in the process, setting a tensile strength Rm of greater than 1800 MPa and an elongation at break A20 of greater than 6%.

The component may be at least partially heated so that certain regions of the component heated to above austenitizing temperature are hardened correspondingly with properties identified above. Complete, homogeneous austenitizing with subsequent hardening is possible with preference. The sheet metal blank preferably has a wall thickness of 0.5 mm to 5.0 mm, and more specifically of 1.0 mm to 4.0 mm.

A brief austenitizing of manganese-boron steels of relatively high carbon content, with subsequent press hardening, may possibly result in increasing not only the hardness but also at the same time the ductility in the hardened state. Prerequisites for this are particularly rapid heating, effected in particular with a gradient or heating rate of greater than or equal to 100° C./second, preferably greater than 200° C./second, and also short hold times at this temperature in a corresponding heating tool. The heating takes place to greater than AC3, more particularly greater than 800° C., preferably greater than 850° C., very preferably greater than 900° C. Preferably, the heating is carried out by contact heating. For example, a heating station having contact heating plates may be provided to conduct contact heating.

A heating time, hold time, and transfer time, before the start of the hot forming less than 30 seconds, and more particularly less than 25 seconds, and more preferably less than 20 seconds, and the associated brief austenitizing have the advantage that small austenite grains are formed, and cementites or other kinds of carbides, present in the initial state, may not be completely dissolved. The small austenite grains and also the undissolved cementites and/or carbides ensure a fine resultant microstructure, during the reconversion in the course of hardening, this microstructure having a high tensile strength in conjunction with high ductility.

It is therefore possible that heating to above austenitizing temperature to be carried out in less than 20 seconds, more particularly less than 10 seconds, preferably less than 8 seconds, and more specifically less than 6 seconds. Moreover, the hold time of the heating temperature or austenitizing temperature is realized in less than 20 seconds, more particularly less than 10 seconds, and preferably less than 5 seconds. Preferably, a short transfer time is carried out as well. The duration of the transfer time is less than 5 seconds. From the start of the heating to the end of the transfer and start of the hot forming, preferably less than 20 seconds elapse.

However, it is also possible for the sheet metal blanks provided to be subjected initially to cold preforming. The product of such a process is a preform. The entirety of the steps identified in this description, of rapid heating, transfer, and hot forming and press hardening of the sheet metal blank, may then be carried out with the preform.

The motor vehicle component produced in this way by press hardening may then have a tensile strength Rm of greater than 1800 MPa, more particularly greater than 1900 MPa, and preferably greater than 2000 MPa. The tensile strength ought to be capped at a technically realizable upper limit. This limit is preferably a maximum of 2500 MPa. At the same time, in the hardened components stated above, however, the component has an elongation at break A20 of greater than 6%, preferably greater than 8%, and particularly greater than 10%. The elongation at break A20 as well is to be capped at a technically realizable order of magnitude, represented preferably by an elongation at break A20 of 20%.

The sheet metal blank may also undergo an initial preliminary coating with, for example, an AlSi coating or a zinc coating. Preferably, the coating is already metallurgically bonded prior to the heating.

As a result of the contact heating, it is possible to achieve the short heat-up time and also the short hold time. It is also possible through contact heating to carry out partially different heating of the blank so that regions of a first kind are brought rapidly to above austenitizing temperature, whereas regions of a second kind are heated at lower than the austenitizing temperature or not at all. A sharply delimited temperature profile can be generated within a very short time.

It is also possible not to harden the entire motor vehicle component, although this is also one preferred variant embodiment of the invention. It is also possible for the motor vehicle component to be hardened only in regions where anticipated loads are high.

It is a further object of the present invention to have a method which can be carried out within the above-stated parameters using a hardenable steel alloy which has a carbon fraction of greater than 0.25%, expressed in weight percent. The steel alloy may have other alloy constituents, and also smelting-induced impurities. It is preferable to use a carbon fraction of greater than 0.30%, more particularly greater than 0.35%. The technical upper limit on the carbon fraction here ought also to be preferably less than 1.0%, more particularly less than 0.50%. It is also preferably to use a steel of designation 38MnB5 or else a 42MnB5.

Moreover, the hardened material microstructure contains 5.0 to 20.0% of bainite in addition to a major fraction of martensite. Residual microstructure constituents formed in the course of the heat treatment are disregarded here. This is made possible in particular by formation of bainite rather than martensite during hardening in the sub-regions in which particularly small quantities of cementites and/or carbides were dissolved. The bainite fraction in particular is beneficial to the ductility of the material.

It is further possible for the hardened motor vehicle component to be subjected again to partial thermal after-treatment. This may be, for example, a partial annealing.

Furthermore, the sheet metal blank processed is not just a single-ply blank made of a steel alloy, but rather a multi-ply sheet metal blank. More specifically, it is a three-ply sheet metal blank. A center ply in this case is composed of an above-designated hardenable steel alloy with at least 0.25% carbon fraction. This ply is designed with, on the top and bottom sides, and therefore externally in each case, a ply of a stainless steel alloy, this ply being thinner in relation. Such a construction is beneficial to the long life of the component since the stainless outer ply provides protection from corresponding scaling and rusting. The plies are preferably already joined to one another in the state in which the multi-ply sheet metal blank is provided. The outer plies preferably each have a thickness of between 3% and 2% of the center ply.

As stainless steel alloy for the outer plies, it has proven particularly advantageous to use a ferritically stainless steel alloy which, besides smelting-induced impurities and iron, comprises the following alloying constituents in weight percent:

Carbon (C): 0.08% to 0.16%
Silicon (Si): 0.5% to 1.8%
Manganese (Mn): 0.8% to 1.4%
Chromium (Cr): 13.0% to 22.0%
Aluminum (Al): 0.5% to 1.5%
Phosphorus (P): not more than 0.06%
Sulfur (S): not more than 0.02%.

Reference may hereby further be made, in terms of other ferritic steel alloys that can be used, to the content of EN 10088-1, with chromium contents of between 10.5 to 30% depending on grade. In order to ensure weldability, stabilizing additions of less than 0.5% of titanium, niobium or zirconium, and also the carbon content limited to 0.16%, are useful. The ferritic stainless steel here, in conjunction with the manganese-boron steel of relatively high carbon content, has proven particularly advantageous in the context of the hot forming and the subsequent press hardening. Component warping and also internal stresses are avoided with this combination of materials.

Moreover, edge decarburization on the motor vehicle component may be carried out. In this procedure, the carbon is removed wholly or partly in the edge region. Edge decarburizing is carried out more particularly in an edge zone of between 5 and 150 μm, measured from the surface. The result is an increase in the flexural angle of the component produced. The flexural angle on the completed motor vehicle component after corresponding edge decarburizing is, in particular, at least 500, preferably at least 60°.

Also, the motor vehicle component produced by the above may partially have a tensile strength of greater than 1800 MPa and an elongation at break A20 of greater than 6%. The motor vehicle component is made of a hardenable steel alloy having a carbon fraction of greater than 0.25%. After the end of the hardening operation it possesses at least partially, and preferably completely, a substantially martensitic material microstructure having a bainite fraction of 5.0% to 20.0%.

The motor vehicle component is a component for a motor vehicle body or a corresponding component which is fixed on a motor vehicle body. Such components are, for example, but not limited to, sills, cross-members, longitudinal beams, crash boxes, roof rails, transmission tunnels, and motor vehicle pillars. The component may alternatively be a fire protection wall, a battery holder, an underfloor, or another sheet metal component of a motor vehicle. Axle components or running-gear components may also be produced by the method.

BRIEF DESCRIPTION OF THE DRAWINGS

The present invention will now be described, by way of example, with reference to the accompanying drawings, in which.

In the figures, the same reference designations are used for identical or similar components, even if a repeated description is omitted for reasons of simplicity.

DETAILED DESCRIPTION OF SOME EMBODIMENTS

Figure 1:
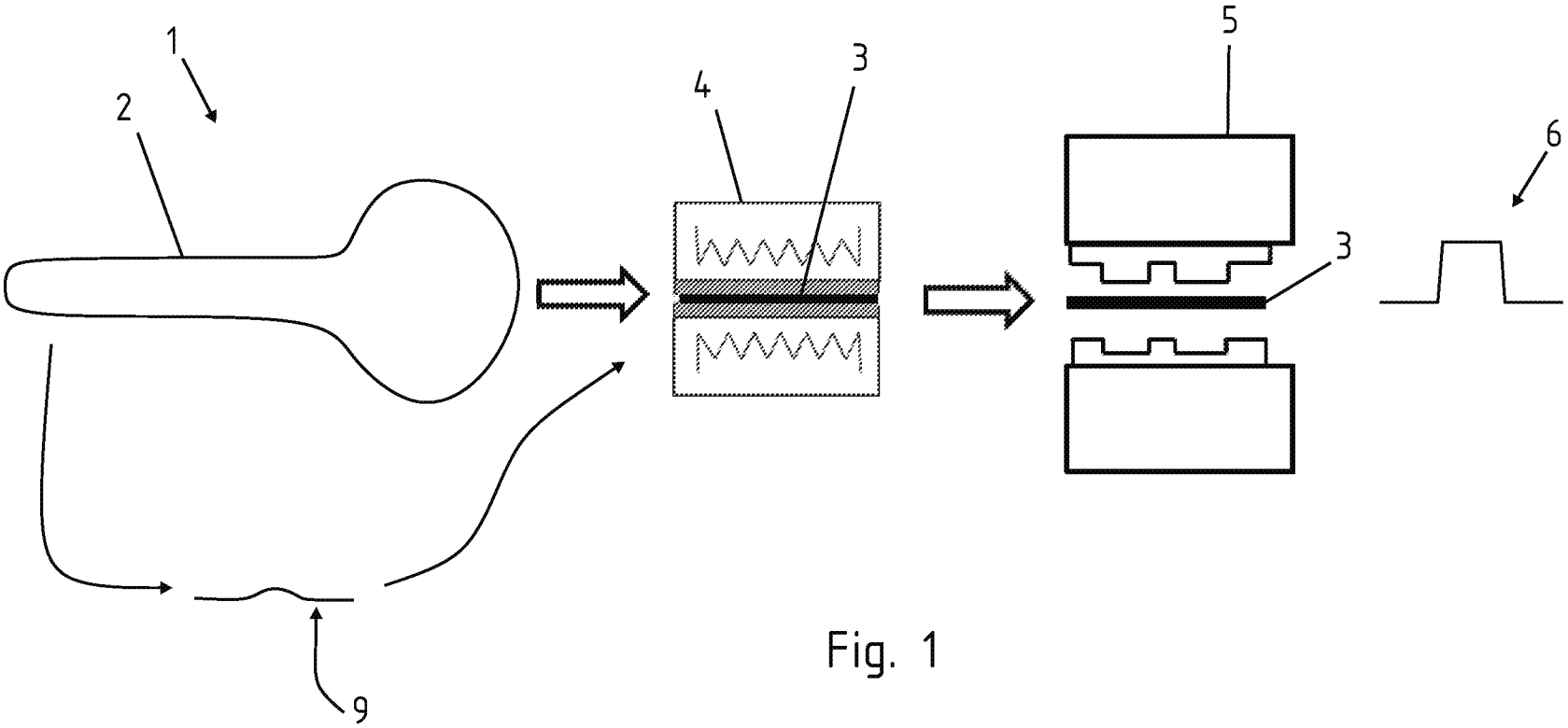
FIG. 1 is a schematic representation of a manufacturing line for manufacturing the vehicle component in accordance with one embodiment.

FIG. 1 illustrates a manufacturing line 1 where, as the first step, a sheet metal blank 2 is provided to be inserted into a contact heating station 4. The sheet metal blank is at least partially heated to above austenitizing temperature. Once the sheet metal blank is heated, it is next transferred to a forming station 5, where it will be subjected to hot forming and press hardening to form a motor vehicle component 6. The sheet metal blank 3 may optionally first be subjected to preforming, for example, cold preforming, illustrated by preform metal blank 9. In that case, it is the preform blank 9 that is heated and further hot-formed and press-hardened in accordance with the process.

Figure 2:
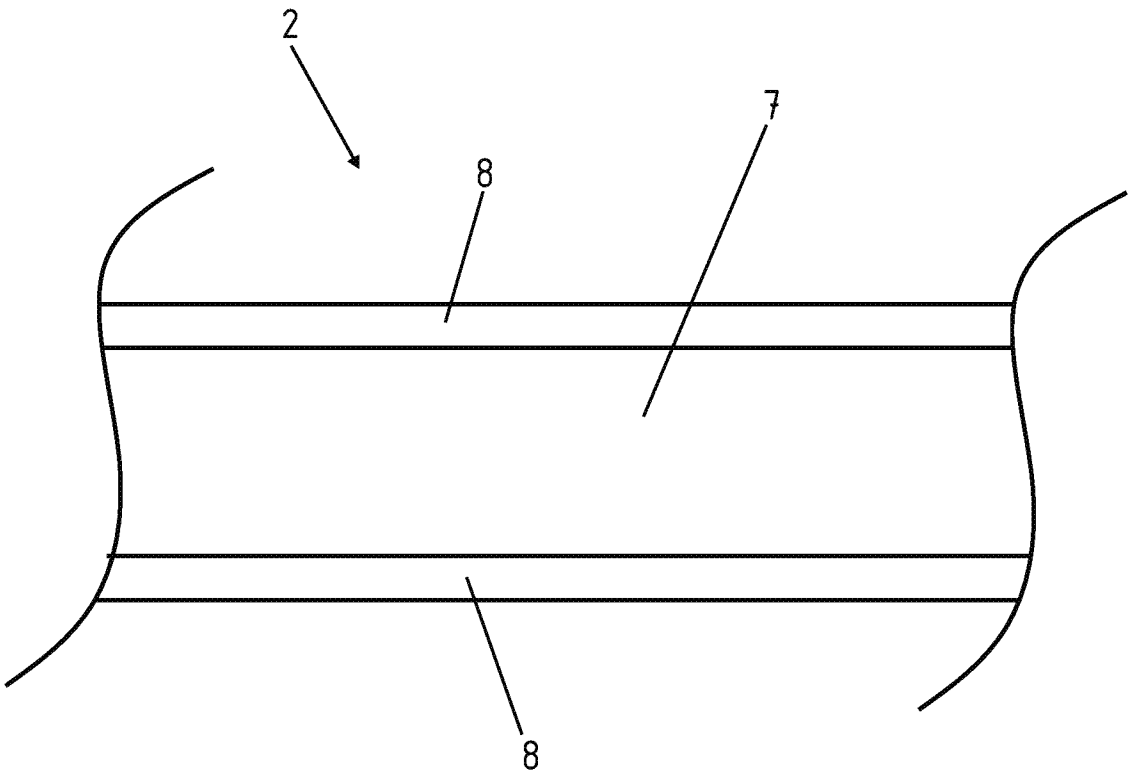
FIG. 2 is a sectional view of a multi-ply sheet metal blank.

FIG. 2 illustrates a three-ply sheet metal blank 2 having a center ply 7 made of a hardenable steel alloy which includes a carbon fraction of at least 0.25%, expressed in weight percent. The two outer plies 8, in contrast, are made of a noncorroding or rust-free steel alloy, and more specifically, made from a stainless steel alloy.

Figure 3:
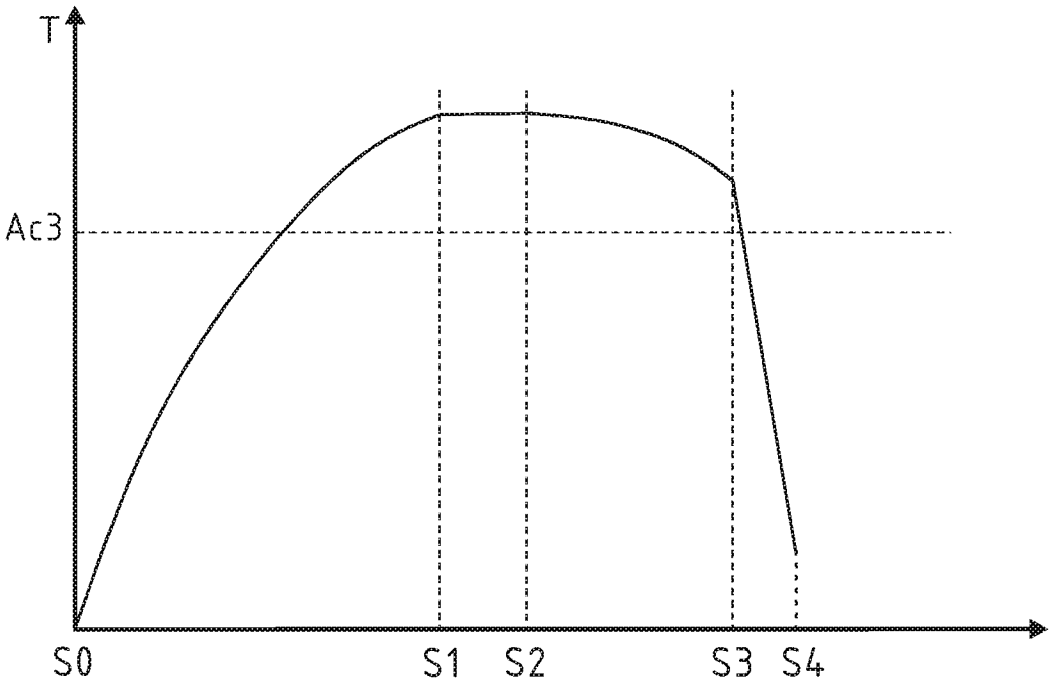
FIG. 3 is a graph representation of time versus temperature illustrating the heat-up phase, the hold phase, and the press-hardening phase.

FIG. 3 illustrates a time-temperature diagram. The temperature is plotted on the Y-axis, and the time is plotted on the X-axis. As can be seen, in a heat-up time from time S0 to time S1, the sheet metal blank is heated to more than AC3 temperature, preferably in less than 10 seconds. In a hold time from time S1 to S2, the heating temperature is then maintained. The hold phase is preferably less than 5 seconds and may in particular also be nearly 0 second. Additionally, a transfer phase is depicted from time S2 to time S3, in which the heated sheet metal blank is transferred from the heating station into the hot-forming and press-hardening tool.

This procedure is preferably carried out in less than 10 seconds, and more particularly in less than 5 seconds. The forming takes place in the range starting from time S3. When forming has taken place, quench-hardening is carried out, so that the temperature drops sharply again from time S3 to S4. The duration of S0 to S3, i.e., heating, optional holding, and transfer time, is preferably accomplished in less than 30 seconds, more particularly in less than 20 seconds.

The foregoing description of some embodiments of the invention has been presented for purposes of illustration and description. It is not intended to be exhaustive or to limit the invention to the precise form disclosed, and modifications and variations are possible in light of the above teachings or may be acquired from practice of the invention. The specifically described embodiments explain the principles and practical applications to enable one ordinarily skilled in the art to utilize various embodiments and with various modifications as are suited to the particular use contemplated. It is intended that the scope of the invention be defined by the claims appended hereto, and their equivalents. Further, it should be understood that various changes, substitutions and alterations can be made hereto without departing from the spirit and scope of the invention as described by the appended claims.

The invention claimed is:

1. A method of manufacturing a motor vehicle component, the method comprising:

providing a sheet metal blank comprising a hardenable steel alloy with greater than 0.35% carbon fraction in weight;

heating the sheet metal blank at a heating rate greater than 100° C./s at least partially to above austenitizing temperature;

holding, during the heating, the sheet metal blank at the heating temperature;

transferring from the heating into a hot-forming and press-hardening tool; and hot-forming and press-hardening the sheet metal blank in the hot forming and press-hardening tool to obtain the motor vehicle component having an elongation at break A20 of greater than 6%, wherein the press-hardening is performed to obtain the motor vehicle component having a tensile strength Rm of greater than 1900 MPa, and the heating, holding, and transferring are performed in less than 30 seconds.

2. The method of claim 1, wherein said press-hardening is performed to obtain the motor vehicle component having the tensile strength Rm of greater than 2000 MPa.

3. The method of claim 1, wherein said press-hardening is performed to obtain the motor vehicle component having an elongation at break A20 of greater than 8%.

4. The method of claim 1, wherein the heating is performed in less than 10 seconds.

5. The method of claim 1, wherein, in the heating, the holding time of the heated sheet metal blank at the heating temperature is less than 20 seconds.

6. The method of claim 5, wherein the transferring time from the heating into the hot-forming and press-hardening tool is in less than 10 seconds.

7. The method of claim 1, wherein a martensitic material microstructure with 5.0% to 20.0% bainite in weight is achieved in the motor vehicle component during the press hardening.

8. The method of claim 1, wherein the heating is contact heating.

9. The method of claim 1, wherein the heating comprises heating the sheet metal blank completely.

10. The method of claim 9, wherein the press-hardening comprises hardening the motor vehicle component only in regions where anticipated loads are high.

11. The method of claim 10, further comprising at least partial thermal after-treatment of the motor vehicle component.

12. The method of claim 1, further comprising preforming the sheet metal blank before the heating.

13. The method of claim 12, wherein the sheet metal blank is multi-ply having a centrally located ply comprising the hardenable steel alloy, and two outer plies comprising a stainless steel alloy.

14. The method of claim 1, wherein said press-hardening is performed to obtain the motor vehicle component having an elongation at break A20 of greater than 10%.

15. The method of claim 1, wherein, in said heating, a first region of the sheet metal blank is heated to a temperature higher than the austenitizing temperature, and a second region of the sheet metal blank is not heated, or is heated to a temperature lower than the austenitizing temperature.

16. A method of manufacturing a motor vehicle component, the method comprising:

providing a sheet metal blank comprising a hardenable steel alloy with at least 0.25% carbon fraction in weight;

heating the sheet metal blank at least partially to above austenitizing temperature;

hot-forming and press-hardening the sheet metal blank to obtain the motor vehicle component having an elongation at break A20 of greater than 6%; and edge decarburizing the motor vehicle component after it is manufactured.

17. The method of claim 16, wherein the edge decarburizing is performed in an edge zone at 5 to 150 μm, measured from a surface of the motor vehicle component.

18. A motor vehicle component manufactured using the method of claim 1, wherein the motor vehicle component has the tensile strength Rm of greater than 1900 MPa and the elongation at break A20 of greater than 6%, and the motor vehicle component comprises the hardenable steel alloy having the carbon fraction of greater than 0.35% in weight and has a substantially martensitic material microstructure with a bainite fraction of 5.0% to 20.0% in weight.

* * * * *